United States Patent [19]

Hellman

[11] 4,017,699

[45] Apr. 12, 1977

[54] DUAL ACTING SNAP SWITCH

[75] Inventor: Robert R. Hellman, Bridgeport, Conn.

[73] Assignee: Westport Development & Mfg. Co., Inc., Milford, Conn.

[22] Filed: May 12, 1975

[21] Appl. No.: 576,705

[52] U.S. Cl. ..... 200/67 D

[51] Int. Cl.[2] ..... H01H 13/36

[58] Field of Search ..... 200/67 R, 67 D, 67 A, 200/67 B, 332, 153 T, 335

[56] References Cited

UNITED STATES PATENTS 2,758,171 8/1956 Cherry, Jr. ..... 200/67 B 2,840,657 6/1958 Roeser ..... 200/67 B

FOREIGN PATENTS OR APPLICATIONS 1,144,612 4/1957 France ..... 200/67 D

*Primary Examiner*—David Smith, Jr.

*Attorney, Agent, or Firm*—Ernest M. Junkins

[57] ABSTRACT

Two single pole flexible blade snap switches are mounted together to have both actuated essentially simultaneously by the same position of a common element by mechanically connecting together but electrically insulating the free ends of the two blades.

4 Claims, 7 Drawing Figures

CONTACT FORCE
DEAD BREAK
N.C.
N.O.
0
OPERATING FORCE ON BLADE
OVER TRAVEL
MOVEMENT
DIFF.
0 1 2 3 4 5 6 7 8 9 10
ACTUATOR MOVEMENT .001 INCHES

DUAL ACTING SNAP SWITCH

Electrical snap switches to which the present invention relates are commonly used to provide an electrical signal represntative of a position of a mechanical element by switching when the position occurs. In some instances, it is desired or required that such an electrical signal be supplied essentially simultaneously to two different electrical circuits, each of which requires its own independent signal. One approach heretofore suggested to provide the two simultaneous signals is to use the signal from a single pole switch to operate a dual circuit or device, such as a double pole relay, with each pole thereof supplying an independent signal.

While this approach adds weight, additional circuitry and at least another component, it has become common rather than the natural and clear approach of using the mechanical element to simultaneously actuate two electrically independent switches. However, attempts to identically operate two switches by the position of a common element has not heretofore been completely successful when both switches must be actuated at the same position of the element which required that essentially simultaneously switching of both switches occur. This is especially true when the switches must always have the same state except when switching and operate for thousands of cycles with the operating position of the common element being maintained essentially constant.

It is accordingly an object of the present invention to provide a dual switch, capable of providing two independent electrical signals which are always of the same state in accordance with the position of a common element with both signals changing essentially simultaneously when switching occurs.

Another object of the present invention is to achieve the above object with a pair of identically constructed single pole switches of the snap blade type in which assurance of the same actuation of each switch is obtained by the force of one blade in switching from one state to another being used to effect switching of the other blade when the other blade only needs a small force to effect its switching.

A further object of the present invention is to achieve the above objects with a dual switch that is economical to construct, is readily assembled from two available single pole switches with only a minimum alteration therein being required and yet which is durable and reliable in use.

In carrying out the present invention, there is provided two single pole switches of the type having a flexible blade which has one end secured to a post and its other end being free for movement between a normally open and a normally closed state in accordance with the position of its actuator. The switch bodies are secured together, as for example, by an adhesive, and are made to operate at essentially the same position of their actuators. The free ends of the blades each have a connector which extends toward the other blade and the two connectors are mechanically connected together in a manner which electrically isolates them.

With the above construction, a common element acting on the actuator of both blades will cause at one position, one of the blades to snap from its normally open state to its normally closed state (or vice-versa) and as the blade's free end passes the mid-point of its movement, it exerts a force which urges it to and at its new state. The mechanical connection between the two blades transfers some of this urging from the first mentioned blade to the second blade so that the latter has a force applied urging it to move to the same state that the first mentioned blade has moved. Further, the urging force from the first moved blade is applied to the delayed blade when the latter's actuator is applying most of the force required for shifting the blade's state so that only the small urging from the first moving blade is needed to assure that both blades attain the same state essentially simultaneously.

Other features and advantages will hereinafter appear.

Referring to the drawing

Figures 1, 2, 3, 4, 5, 6, 7:
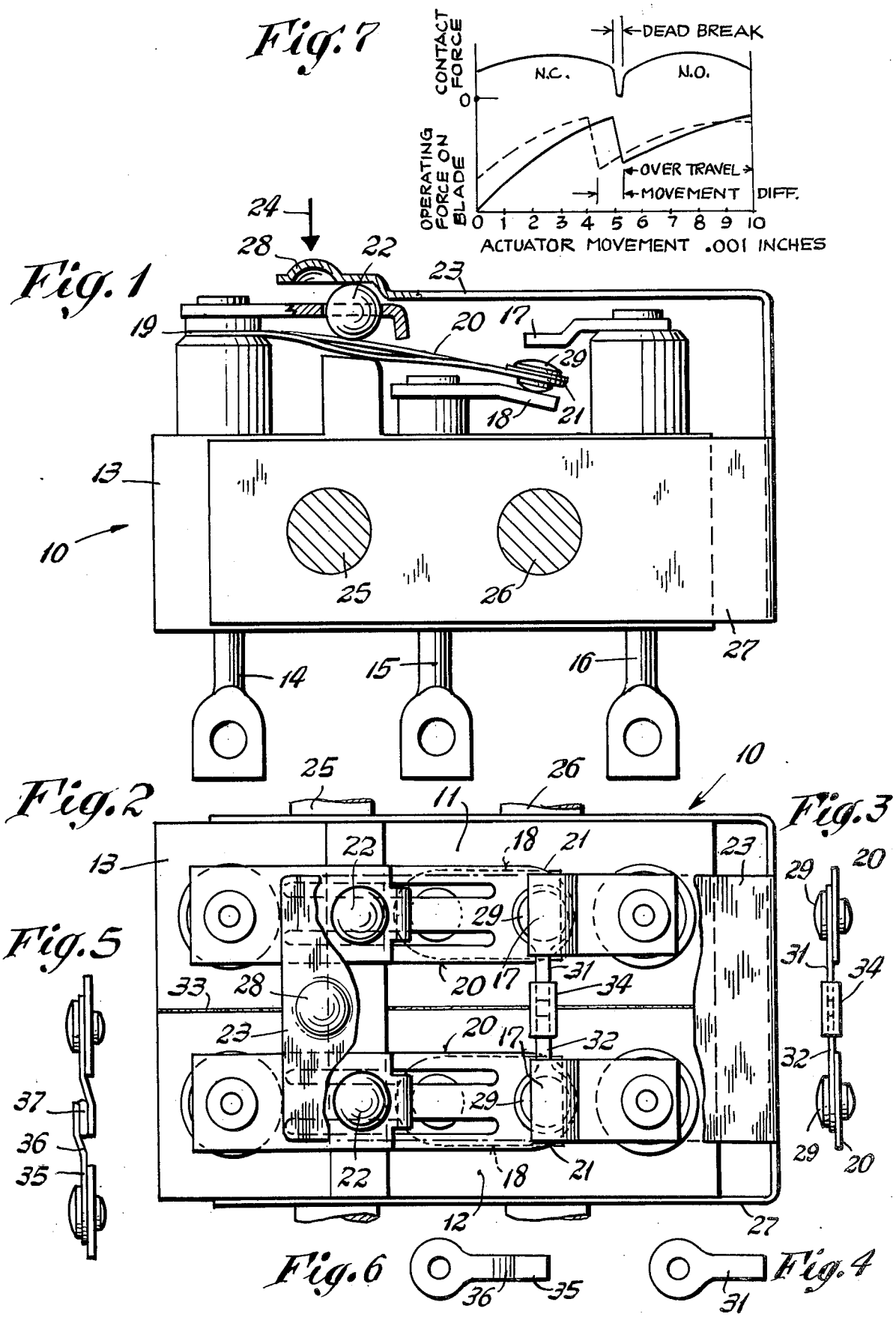
FIG. 1 is an elevation, partially in section of the dual switch of the present invention shown somewhat enlarged.
FIG. 2 is a top view thereof with portions broken away.
FIG. 3 is an end view of the free ends of the blades showing their connection.
FIG. 4 is a plan of the connector used in the embodiment of FIG. 3.
FIG. 5 is a view similar to FIG. 3 of the free ends with a further embodiment of the connection.
FIG. 6 is a view of the connector used in FIG. 5 embodiment.
FIG. 7 is a plot of various conditions occurring in a snap blade switch.

Referring to the drawing, the dual switch of the present invention is generally indicated by the reference numeral 10 and includes a pair of identical single pole switches 11 and 12. Referring to the switch 11, it has a body 13 of somewhat rectilinear shape formed from rigid electrically insulating material to support three terminals 14, 15 and 16. The terminal 16 is connected to a normally open contact 17, terminal 15 to a normally closed contact 18 and the terminal 14 to one end 19 of an over center snap switch blade 20. The blade 20 is mounted at its end 19 with its other end 21 being free for movement.

The blade normally assumes the normally open state shown, wherein the free end 21 of the blade is urged against the contact 18 so as to electrically connect the terminals 14 and 15 by current flow through the blade. However, a force on the blade effecting downward movement in FIG. 1, causes the blade to be distorted and snap to a normally closed state where the free end 21 is urged against the contact 17 to electrically connect the terminal 14 to the terminal 16. The force or movement is applied to the blade, in the particular embodiment of the switch shown, through a sapphire ball 22, positioned as shown and an arm 23 in engagement therewith with the mechanical movement being indicated by the arrow 24. For a fuller description of this specific embodiment of the switch construction, though it will be understood that the invention is not to be limited solely thereto, reference is made to my U.S. Pat. No. 3,278,700, assigned to the assignee of the present invention.

The bases of both switches 11 and 12 are formed with through apertures by which they are supported, as for example, by abbreviately shown, pin or screw support members 25 and 26. The apertures are essentially aligned and the actuator arm 23 is mounted to the bases by the same support members 25 and 26 through a U-shaped lower base portion 27 from which the actuating arm 23 integrally extends upwardly and over the sapphire balls. As shown in FIG. 2, the arm 23 has sufficient width so that separated portions thereof engage the balls 22. Also, the force 24 is applied to a protrusion 28 that is formed between the portions of the arm 23 that engage the balls. It will also be noted that switch arm 23 has sufficient width and rigidity to resist twisting so that the linear movement of the projection 28 is applied as an identical linear movement to both balls 22.

In the construction of each switch 11 and 12, each switch blade 20 has a contact button 29 secured in an aperture at its free end 21 as by staking or other mechanical distortion of the button. However, prior to such securement, a connector 31 (FIG. 4) is placed on each button so that the button securement also secures the connector to the blade. The switch 11 thus has the connector 31 and the switch 12, the connector 32 with each switch having its connector extending as shown in FIGS. 2 and 3. Each switch is then assembled and each is adjusted relative to one another so that each switch is actuated at essentially the same position of its ball 22, within less than a few thousands of an inch of each other. The switches are then secured together with their through support holes aligned, as by an adhesive 33 and further mechanical adjustments are made to the switches to assure that they are actuated at a position within one or so thousands of an inch of each other. This may be achieved by bending the switch parts slightly or by slight relative shifting of the switches prior to the setting of the adhesive. The two connectors are then mechanically connected together as by a sapphire tube 34 and ceramic cement, or other adhesive. The connection is rigid yet electrically insulating.

In the embodiment shown in FIG. 5, a connector 35 may be formed with a step 36 and the securement may be in the form of just a bead of hardened epoxy adhesive 37, positioned at least between the overlying portions of the connector. Thus, in both embodiments, the free ends of the two blades are mechanically secured together but yet electrically insulated from each other.

Shown in FIG. 7 is a plot of different operating characteristics of a snap blade switch of the type shown herein. In the lower plot, it will be noted that as the actuator movement increases in thousandths from 1, 2, 3, 4 to almost 5, which is the distance that a ball 22 is moved towards its base, that at approximately the five position, the blade will be actuated to shift its state and further actuator movement may occur while the blade retains the same state. The blade will only assume one or the other of its states, and not an intermediate location where it does not touch either contact, so that there is only one position of the actuator, within a range of positions, where actuation is produced.

It will be also noted that the ordinate sets forth relative values of the operating force on the blade which is the minimum force that must be exerted on the blade for the actuator movement indicated. The force required to be produced by the actuator increases with increasing movement until actuation, when there is a sharp decrease, and then a subsequent increase for overtravel of the actuator.

The upper plot in FIG. 7 represents the contact force or the spring urging of the free end against its engaged contact. It basically remains constant, decreases to zero (dead-break) at the midpoint of its snap actuation and then increases as it assumes its other state.

Thus the actuation movement 24 causes both balls 22 and their blades to move downwardly and one of the blades (at about the five position) will be actuated while the other blade requiring a slightly longer actuator movement has not been actuated. However, the additional amount of movement needed has been made to be small, which makes the additional operating force required on the delayed blade small, being only that which the actuator would have to produce by further movement of the delayed blade to cause its actuation. This additional force is supplied by the contact force of the other blade as it assumes its other state through the connectors 31 and 32. Accordingly, by selecting the switches and adjusting same so that they basically operate at about the same actuator position (0.0001 inches not being uncommon), one of the blades will be actuated before the other but the amount of additional force required on the other blade to actuate it, is less than that which the actuated blade has in its spring tension caused by its being actuated. Thus, the construction of the switch of the present invention assures that if one blade is actuated, the other blade will be actuated by the actuation of the first blade.

This is important consideration, since the actuator movement could stop just after the first blade is actuated and the second blade would then remain unactuated. This would produce two different signals which would render a dual switch unsatisfactory as both must produce identical signals at all times. The duration between actuation of the first blade and actuation of the second has been found to be only a few milliseconds which basically makes the actuations occur essentially simultaneously.

It will be noted on the lower plot in FIG. 7 that the reverse movement (from contact 17 to contact 18) of a blade is plotted with a dotted line and the difference results from the differential movement inherent in the switch. However as the actuation of one blade actuates the other, essentially simultaneously actuation occurs irrespective of which blade is actuated first when the actuation movement is in the other direction. This prevents any slight difference in differential movement between the switches from varying the simultaneousness of operation in the change from the normally closed to the normally open state.

While one form of arm 23 has been shown, it is contemplated that other styles may be employed, as for example that shown in U.S. Pat. No. 3,609,269, assigned to the assignee of the present invention which enables the dual acting switch to be placed in an heremetically sealed enclosure.

It will be accordingly understood that there has been disclosed a dual switch for producing two independent electrical signals that are always identical except for an extremely short duration that exists between their actuation times. An actuator produces the same movement on each switch and one switch becomes actuated before the other. However by utilizing the force that the one switch has when actuated to overcome the difference in their movement required for actuation, assurance that both will be essentially simultaneously identically actuated is thereby obtained.

Variations and modifications may be made within the scope of the claim and portions of the improvements may be used without others.

I claim:

1. A dual switch for providing two electrically independent but almost always identical signals comprising a first switch having a snap-acting blade and means for receiving a movement to the blade to cause it to be actuated to shift from one of its states to its other state, a second switch identical to the first having a snap-acting blade and means for receiving a movement to the blade to cause it to be actuated to shift from one of the states to its other state, each of said switches including a base with its blade being mounted thereon at one end to have its other end free with the free ends of the blades being adjacent and moving in the same direction to produce the same signal, means securing the switches together with both blades being actuated by no more than a small difference in movement therebetween, means for applying an identical movement to the means for receiving of each blade to urge their actuation and means for causing the blade that is initially actuated to apply a force to the other blade to urge it to be actuated to the same state as the initially actuated blade, said means including a mechanical connection that is electrically non-conducting between the two free ends of the blade whereby the force from the initially actuated blade is obtained from the free end of the blade and is applied at the free end of the other blade.

2. The invention as defined in claim 1 in which the other blade has simultaneously applied both the movement means urging actuation and the force for urging from the initially actuated blade with the movement means urging being greater than the force from the initially actuated blade, said movement means urging being applied at one location on the other blade and the force from the initially actuated blade being applied at a different location on the other blade.

3. The invention as defined in claim 1 in which the connecting means includes a rigid connector extending from each blade towards the other and in which a relatively rigid tube of electrical insulating material receives adjacent portions of the connectors.

4. The invention as defined in claim 1 in which the connecting means includes a metal arm extending from each blade towards the other and in which a hardened, electrically insulating adhesive secures the adjacent ends of the arms together.

* * * * *